US008033533B2

(12) United States Patent
Ring et al.

(10) Patent No.: US 8,033,533 B2
(45) Date of Patent: Oct. 11, 2011

(54) UNIVERSAL BRAKE ASSEMBLY

(75) Inventors: Michael E. Ring, Saint John, IN (US); Gary L. Voong, Bolingbrook, IL (US); Eric S. Graves, Crown Point, IN (US); Frank E. Tinch, Bourbonnais, IL (US)

(73) Assignee: WABTEC Holding Corp., Wilmerding, PA (US)

( * ) Notice: Subject to any disclaimer, the term of this patent is extended or adjusted under 35 U.S.C. 154(b) by 140 days.

(21) Appl. No.: 10/645,035

(22) Filed: Aug. 21, 2003

(65) Prior Publication Data

US 2005/0040575 A1 Feb. 24, 2005

(51) Int. Cl.
*F16F 5/00* (2006.01)
*F16F 9/00* (2006.01)

(52) U.S. Cl. ..... 267/64.11; 188/33; 188/361; 188/153 R

(58) Field of Classification Search ..... 188/33, 188/34, 49–55, 361, 153 R, 153 D, 208, 209, 188/219.1; 267/64.11, 64.23, 64.28, 140.11
See application file for complete search history.

(56) References Cited

U.S. PATENT DOCUMENTS 2,879,077 A * 3/1959 Chalmers ..... 280/124.177
3,768,826 A * 10/1973 Hickman ..... 280/687
4,693,486 A * 9/1987 Pierce et al. ..... 280/80.1
4,711,464 A * 12/1987 Bilas ..... 280/86.5
4,846,785 A * 7/1989 Cassou et al. ..... 600/34
6,116,385 A * 9/2000 Ring ..... 188/153 D
6,142,480 A * 11/2000 Streitman et al. ..... 277/439
6,267,043 B1 * 7/2001 Plantan et al. ..... 92/63
6,279,689 B1 * 8/2001 Zemyan ..... 188/33
6,279,696 B1 * 8/2001 Daugherty et al. ..... 188/215
6,619,443 B2 * 9/2003 Ring et al. ..... 188/153 R
6,792,704 B2 * 9/2004 Johnson ..... 37/235

* cited by examiner

*Primary Examiner* — Melody M Burch
(74) *Attorney, Agent, or Firm* — James Ray & Associates, LLC

(57) ABSTRACT

An air spring actuated brake assembly for a railway vehicle braking system is provided which comprises an air spring disposed between a mounting member for attachment to the rigid structure of the braking system and a push rod attached thereto for longitudinal movement in an outward direction upon actuation thereof to initiate a braking sequence of the railway vehicle braking system. The air spring actuated brake assembly of the present invention allows for improved control of the brake shoe forces including visual travel measurement indication which is especially desirable during light load conditions. Additionally the air spring actuated brake assembly of the invention allows for the visual inspection and simple replacement of an inflatable spring should an air leak in the actuator occur. Currently used brake assemblies employing cylinder type actuators may be retrofitted with the air spring actuator of the invention.

12 Claims, 4 Drawing Sheets

UNIVERSAL BRAKE ASSEMBLY

FIELD OF THE INVENTION

The present invention relates, in general, to a brake mechanism for use in railway vehicle brake assemblies and, more particularly, this invention relates to a brake mechanism using an air spring actuator for initiating a braking sequence in railway vehicle brake assemblies and, still more specifically, the invention relates to truck-mounted brake assemblies.

BACKGROUND OF THE INVENTION

As is generally well known in the railway industry, truck mounted braking systems comprise a series of force transmitting members, levers and linkages which function to move a group of brake shoes against the wheels of a railway vehicle to effect stoppage of such railway vehicle. A pneumatically activated brake cylinder is typically provided in the braking system to initiate movement of this series of force transmitting members, levers and linkages to apply the brakes of the railway vehicle mounted to a truck assembly of said railway vehicle.

A well known type of truck mounted braking system is a TMX® truck mounted braking system (TMX® is a registered trademark to Westinghouse Airbrake Company, the assignee of the present invention). A currently used pneumatically activated brake cylinder for truck mounted braking systems generally comprises of an air cylinder piston which moves in a forwardly direction within a cylindrical member upon the application of pneumatic pressure thereto. A seal and/or diaphragm is provided on or adjacent a first end of the piston. This seal and/or diaphragm contacts the inner surface of the cylindrical member so as to provide an airtight chamber at one end of the cylindrical member such that application of pneumatic pressure therein and against the first end of the piston enables forward movement of the piston. A piston rod is attached at a second end of the piston and moves in response to the movement of the piston. An opposite end of the piston rod is connected to the end of a push rod which is, in turn, connected to a cylinder force transfer lever. This cylinder force transfer lever is connected through a series of force transmitting members and linkages so as to activate a braking sequence and apply the brake shoes to the vehicle wheels.

A disadvantage of this type of pneumatically activated brake cylinder is that due to regulations regarding the amount of air pressure which must be supplied into the brake cylinder, it is sometimes difficult to control the movement and/or force applied by the piston. Some countries require that a certain amount of pressure, such as at least 1-1.15 bar greater than atmosphere, be applied within the brake cylinder. During light load conditions, too much force applied by the piston can cause the brake shoe forces to be greater than necessary resulting in wheel skid.

Another disadvantage is that care must be taken in the maintenance of the seals and/or diaphragms within the cylindrical member to ensure that leaking of air does not occur, resulting in a loss of pressure and a reduced amount of force being applied by the piston/piston rod assembly. Also, when cracking and/or deterioration of the seals and/or diaphragms does occur, the air brake cylinder must be completely disassembled in order to repair or replace the defective components. The difficulty in determining the condition of the components lies in that the components are contained within the cylindrical member thus resulting in a need for disassembly for inspection purposes.

An additional disadvantage of the currently used air brake cylinders is their inability to accommodate piston bail or misalignment without leaking air. In addition, it is impractical to visually determine the proper relationship between the actual stroke of the cylinder and the brake shoe force during braking.

U.S. Pat. No. 6,116,385, Dual Force Range TMX Cylinder Using an Airspring Actuator teaches a pneumatically activated brake cylinder which comprises a cylindrical casing engaged with a railway vehicle braking system. A hollow piston assembly having a first surface and an opposed second surface is mounted for reciprocal movement within the cylindrical casing. There is at least one air spring actuator engageable with the first surface of the hollow piston assembly and an opposed inner surface of such cylindrical casing. An air communication means is in fluid communication with an interior portion of the at least one air spring actuator for allowing the application and removal of air from the air spring actuator during a brake application or a brake release, and a piston rod assembly is associated with the opposed second end of the hollow piston assembly. This piston rod assembly is capable of movement in an outward direction from the cylindrical casing upon actuation of the air spring actuator to initiate a braking sequence for the railway vehicle braking system. The air communication means comprises an air inlet means which is provided in the cylindrical casing and the air spring actuator to enable application of pneumatic pressure within the air spring to form a first air cavity.

A packing cup is provided on the hollow piston assembly producing a seal between the hollow piston assembly and the inner surface of the cylindrical member to form a second air cavity. An air inlet flange is also provided on the cylindrical member to enable the application into and the evacuation of air from the second cavity.

The teaching of U.S. Pat. No. 6,116,385, Dual Force Range TMX Cylinder Using an Airspring Actuator is incorporated herein by reference thereto.

Although the TMX® braking system offers improved performance of the airbrake cylinder in certain applications, there is a need for a simpler device having less components.

SUMMARY OF THE INVENTION

The universal brake assembly of the present invention comprises a mounting member for attachment to the rigid structure of the braking system having a substantially planar first surface. A push rod/shield actuation member is engaged with the force transmitting linkage of the brake assembly and has a first substantially planar surface. At least one air spring actuator is engageable with the first planar surface of the mounting bracket and with the first planar surface of such push rod/shield actuator for reciprocal motion therein. There is an air communication means in fluid communication with the at least one air spring actuator for allowing the application and removal of air from the air spring actuator during a brake application or a brake release. The push rod/shield actuating member is capable of longitudinal movement in an outward direction upon actuation thereof to initiate a braking sequence of the railway vehicle braking system. The air communication means comprises an air inlet means which is provided in the air spring actuator to enable application of pneumatic pressure regulated by an external control circuit. A visual travel indicator means is provided to permit determination of the forces generated upon pressurization of the air spring actuator that vary with respect to the travel height of such air spring actuator due to the natural characteristics of the rubber. Guiding means includes engagement of a first edge surface and a second edge surface of the push rod/shield actuator with the first edge surface and second edge surface of the mounting bracket, respectively, to substantially minimize loading forces onto such brake actuator due to linkage bail and/or misalignment.

OBJECTS OF THE INVENTION

It is an object of the present invention to provide an air spring actuated brake mechanism assembly for a railway vehicle braking system which allows for improved control of the brake shoe forces.

Another object of the present invention is to provide an air spring actuated brake mechanism which allows for a reduced amount of pressure to be applied to the air spring actuator pushrod during light car conditions.

Still another object of the present invention is to provide an air spring actuated brake mechanism assembly which is capable of linkage bail and/or misalignment without leaking air.

Yet another object of the present invention is to provide an air spring actuated brake mechanism assembly which requires less maintenance to maintain the air tightness of the system and allows for the simple replacement of an inflatable spring should an air leak in the actuator occur.

A further object of the present invention is to provide an air spring actuated brake mechanism assembly which provides an economically desirable alternative to the seal/diaphragm system currently in use.

Still yet another object of the present invention is to provide an air spring actuated brake mechanism assembly which includes a means for visual inspection of the air spring actuator that does not require disassembly of the mechanism.

Yet still another object of the present invention is to provide an air spring actuated brake mechanism assembly which includes means for visual determination of the air spring actuator travel during a brake actuation in order to determine the force applied by the air brake shoe.

An additional object of the present invention is to provide an air spring actuated brake mechanism assembly which has a positive stop in order to prevent over compression and consequently damage to the air spring actuator.

Yet an additional object of the present invention is to provide an air spring actuated brake mechanism assembly which can be easily retrofitted into existing applications.

Although a number of objects and advantages of the present invention have been described in some detail above, various additional objects and advantages of the brake cylinder of the present invention will become more readily apparent to those persons who are skilled in the art from the following more detailed description of the invention, particularly when such detailed description of the invention is taken in conjunction with both the attached drawing figures and with the appended claims.

Figure 1:
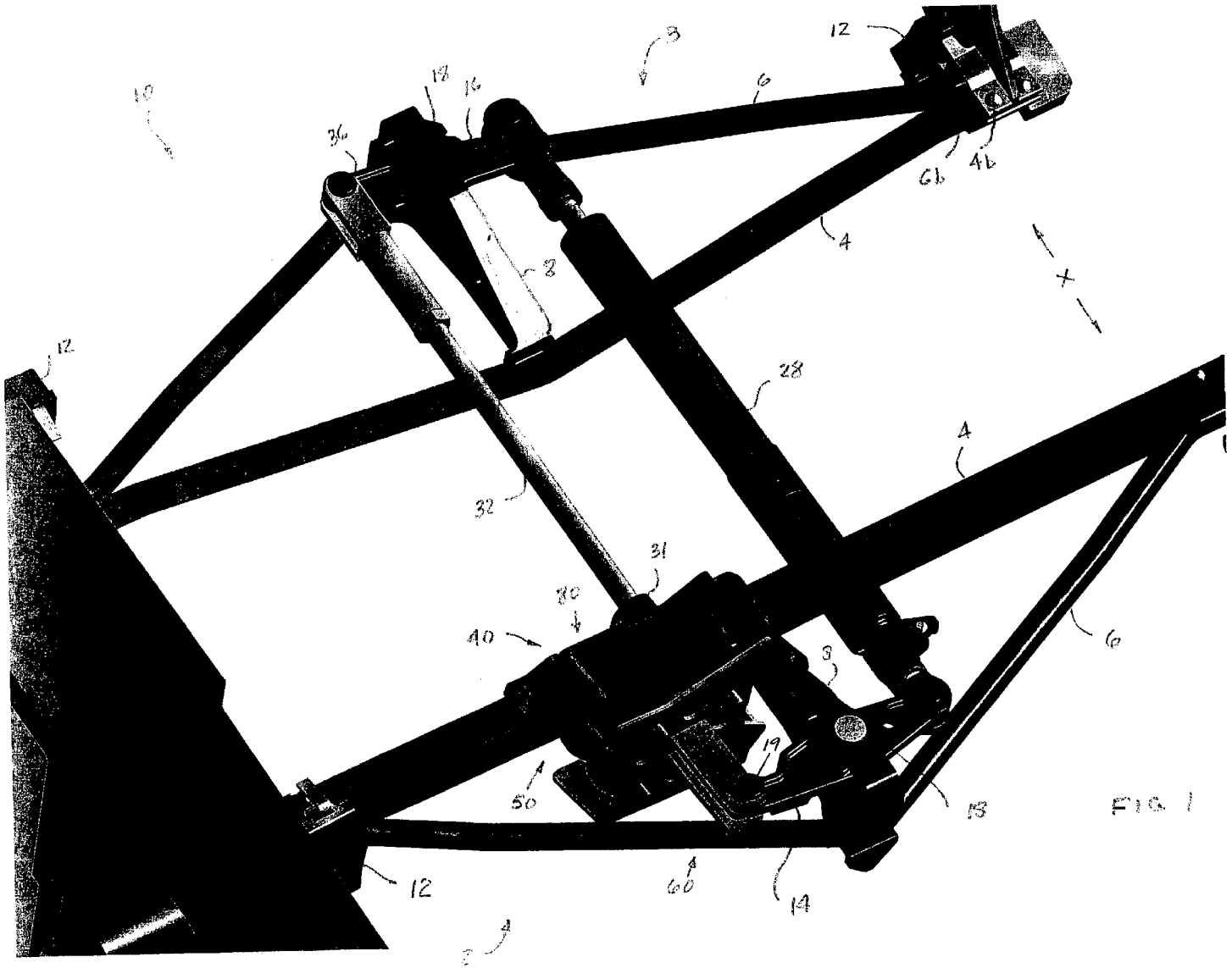
FIG. 1 is a perspective view of a railway vehicle truck mounted brake arrangement including a presently preferred embodiment of the universal brake assembly of the present invention.

DETAILED DESCRIPTION OF A PRESENTLY PREFERRED AND VARIOUS ALTERNATIVE EMBODIMENTS OF THE INVENTION

Prior to proceeding with the more detailed description of the invention, a description of a truck mounted braking system and its functioning should provide helpful in understanding the present invention. Also, it should be noted that for the sake of clarity, identical components which have identical functions have been identified with identical reference numerals throughout the several views illustrated in the attached drawing figures.

Referring now to FIG. 1, there is shown a presently preferred embodiment of a truck-mounted brake assembly, generally designated 10, for a railway car (not shown). This brake assembly 10 comprises brake beams, generally designated 2 and 3, which are substantially identical. Each of the brake beams 2 and 3 includes a compression member 4, a tension member 6 and a strut member 8. The opposite ends of the compression member 4 and the tension member 6 may be permanently connected together, preferably by welding, along an outer segment (not shown) at the opposite ends of the compression member 4 and the tension member 6.

At a location substantially midway between their opposite ends, the compression member 4 and the tension member 6 of the, respective, brake beams 2 and 3 are spaced apart sufficiently to allow connection of the strut member 8 therebetween. Mounted on the respective outer end segments of the brake beams 2 and 3 are brake heads 12.

A pair of force-transfer levers 14 and 16 are pivotally connected by pins 18 to the strut member 8 of the respective brake beams 2 and 3. One end of the respective force-transfer levers 14 and 16 is interconnected via a force-transmitting member 28, which may be in the form of a slack adjuster device. The opposed end 36 of the force-transfer lever 16 is connected to an at least one brake actuator assembly 40 by connecting means 31 via a force-transmitting member or a return push rod assembly 32.

Figure 2:
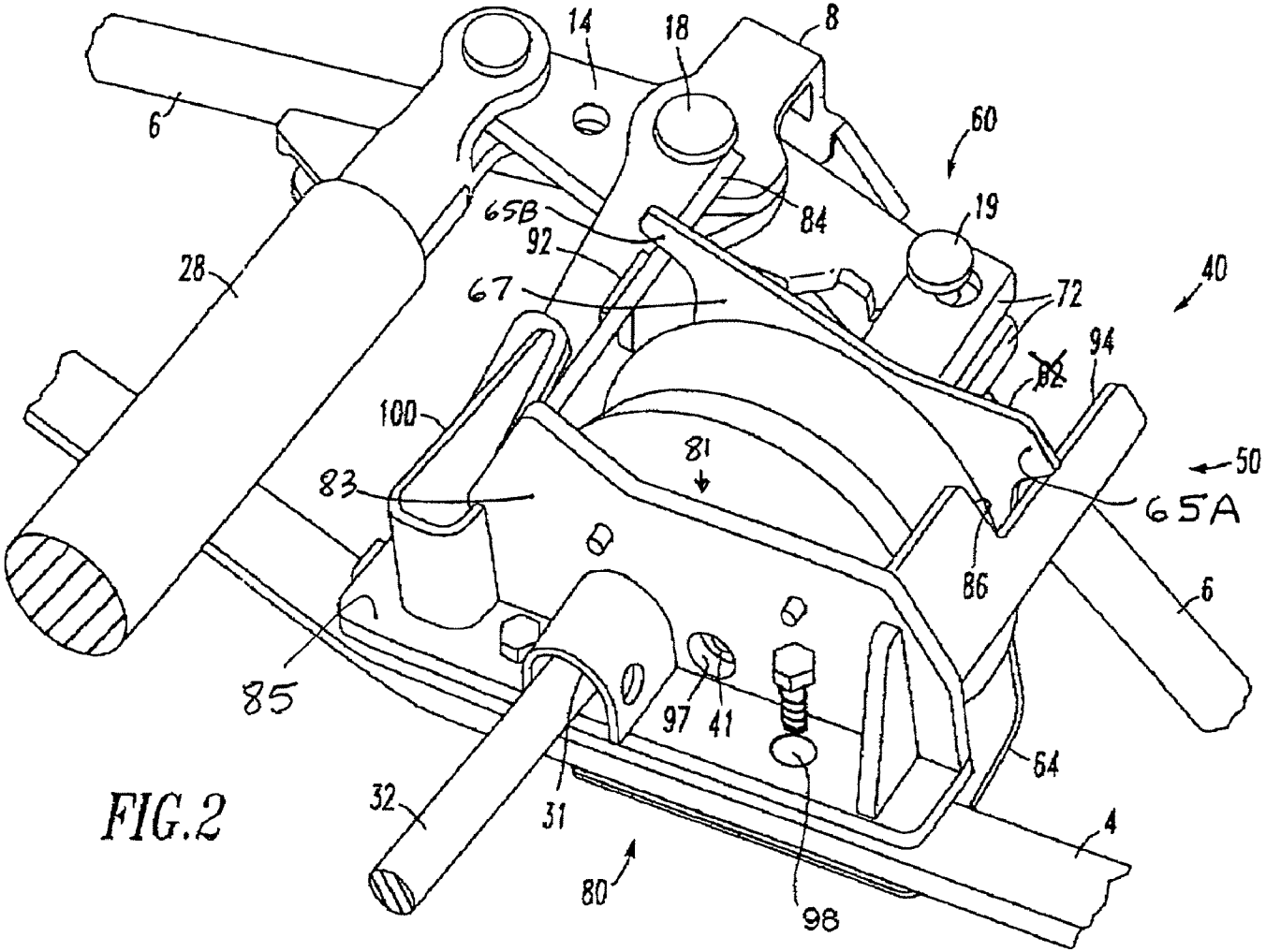
FIG. 2 is a partial perspective view of a railway vehicle truck mounted brake arrangement showing the air spring actuator of the present invention.

In further reference to FIGS. 1 and 2 when a brake application is made, pressurization of the air spring actuator, generally designated 50, will result in movement of actuating member, generally designated 60, connected with force transfer lever 14 in a forward direction to effect a counterclockwise rotation of said force transfer lever 14. The force transfer lever 14, in turn, actuates the slack adjuster assembly 28 to effect counterclockwise rotation of the force-transfer lever 16 and consequent actuation of the return push rod assembly 32.

The force-transfer levers 14 and 16, along with the slack adjuster assembly 28, the return push rod assembly 32 and the brake actuator assembly 40 comprise a brake beam actuating linkage that interconnects the, respective, brake beams 2 and 3 via the pivot pins 18 and thus the required brake actuation forces effectively act along these pivot pins 18. The resultant of these forces is shown at X. Because the slack adjuster assembly 28 acts as a rigid member during a brake application, it is important that the length of the slack adjuster assembly 28 be allowed to increase with brake shoe wear and/or loss of a brake shoe during service so that movement of the push-rod/shield 60 will enable such brake beams 2 and 3 to be moved apart by the brake beams linkage until brake shoe engagement with the tread surface of the vehicle wheels occurs.

Any well-known technique may be used to position and/or mount the brake actuator assembly 40 to the braking system. For example, such brake actuator assembly 40 can be connected to both the strut member 8, adjacent one side thereof, and to the compression member 4 in the space located between the compression member 4 and the tension member 6. In this particular arrangement, the weight of the brake actuator assembly 40 and the force-transmitting members is carried by the brake beams 2 and 3, which are, in turn, supported by the truck side frames (not shown). A connecting means 31 is provided for connecting a back portion of the mounting member with the return push rod 32.

Figure 3:
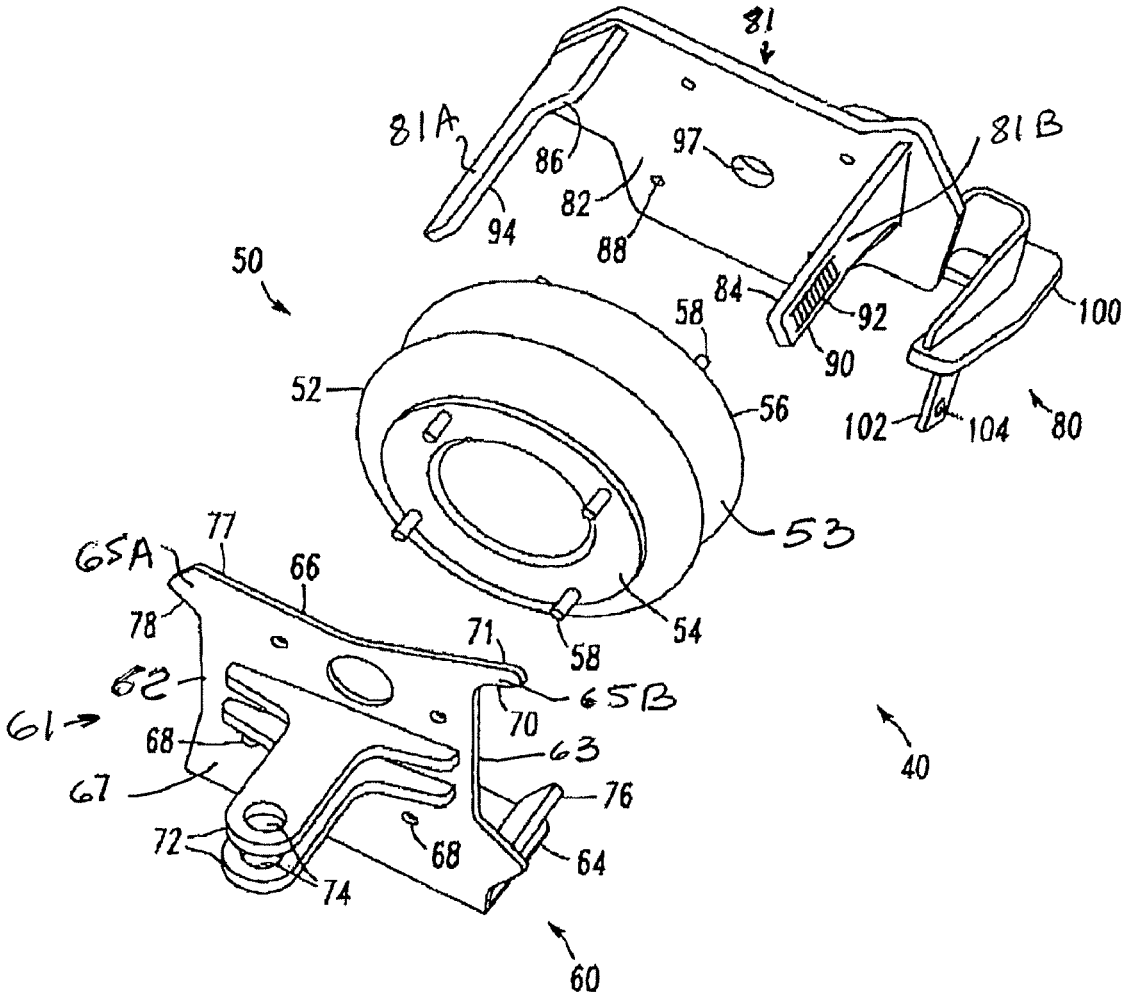
FIG. 3 is a perspective view of the air spring actuator assembly.

In a particular reference to FIGS. 2-3 air brake actuator assembly 40 consists of at least one air spring actuator 50 disposed between the actuating member 60 and a mounting bracket member, generally designated 80. When installed in the truck mounted brake assembly 10, the at least one air spring actuator 50 has a first substantially vertical surface 54 and an opposed second surface 56 spaced apart from and disposed substantially coplanar to the first substantially vertical surface 54. At least one inflatable air bag or air spring 52 is disposed between end surfaces 54 and 56 and defines an exterior peripheral surface 53 of the air spring 52. Each end surface 56, 54 has at least one and, preferably a plurality of mounting members 58 extending outwardly therefrom.

The actuating member 60 includes a first plate member 61 disposed substantially vertically during use of the air brake actuator assembly 40, the first plate member 61 having a first substantially planar surface 66 thereof disposed in abutting relationship with the end surface 54 of the air spring actuator 50, the first plate member 61 exposing the exterior peripheral surface 53 of the at least one inflatable air spring 52 to an atmospheric operating environment characterized by a presence of detrimental extraneous foreign material when the railway car mounted brake assembly 10 is in use.

The first plate member 61 further has a plurality of first mounting apertures 68 formed through a thickness thereof, each of the plurality of first mounting apertures 68 aligned with and sized to pass therethrough a respective one of the plurality of mounting members 58 extending outwardly from the end surface 54.

The actuating member 60 also includes a pair of plate portions 65A, 65B disposed planar with the first plate member 61 adjacent a top edge thereof. One plate portion, labeled as 65A in FIG. 3, protrudes outwardly from a side edge 62 of the first plate member 61. The other plate portion, labeled as 65B in FIG. 3, protrudes outwardly from an opposed side edge 63 of the first plate member 61.

A structure is disposed on and attached to an opposed second surface 67 of the first plate member 61 for securing the actuating member 60 to an actuating linkage of the railway vehicle brake assembly 10. Such structure includes a pair of elongated members 72 disposed substantially horizontally and spaced apart in a vertical plane during use of the air brake assembly 40, each of the pair of spaced apart elongated members 72 having a proximal end thereof disposed on and attached to an opposed substantially planar surface 67 of the first plate member 61, a distal end thereof extending outwardly and substantially perpendicular to the first plate member 61, and an aperture 74 formed through a thickness of the each of the pair of elongated members 72 adjacent to and spaced from the distal end thereof. The apertures 74 are employed for connection for force-transfer levers 14 and 16 by pins 19.

The actuating member 61 additionally includes a second plate member 64 disposed substantially horizontally during use of the air brake actuator assembly 40. The second plate member 64 is directly attached to the first plate member 61 at a bottom edge thereof and extends substantially perpendicular to the first substantially planar surface 66 of the first plate member 61 for shielding at least a first portion of the exterior peripheral surface 53 of the air spring actuator 50 from the detrimental extraneous foreign material.

The actuating member 61 further includes a third plate member 76 connected to an upper surface of the second plate member 64 and to the first planar surface 66 of the first plate member 61 adjacent side edge 63 thereof and extending substantially perpendicular to at least the first plate member 61 for shielding at least a second portion of the exterior peripheral surface 53 of the air spring actuator 50 from the detrimental extraneous foreign material and for providing added strength between the first plate member and the second plate member.

This actuating member 60 is capable of movement in an outward direction upon actuation of the air spring 52 to initiate a braking sequence of the railway vehicle braking system 10.

In further reference to FIGS. 2-3, the air brake actuator assembly 40 includes a mounting member or bracket, generally designated as 80. The mounting bracket 80 includes a plate member 81, which is disposed substantially vertically during use of the air brake actuator assembly 40. The plate member 81 has a first substantially planar surface portion 82 thereof disposed in abutting relationship with the end surface 56 of the air spring actuator 50. The plate member 81 further has a plurality of mounting apertures 88 formed through a thickness thereof, each of the plurality of mounting apertures 88 aligned with and sized to pass therethrough a respective one of the plurality of mounting members 58 extending outwardly from the end surface 56. The plate member 81 exposes the exterior peripheral surface 53 of the at least one inflatable air spring 50 to an atmospheric operating environment characterized by a presence of detrimental extraneous foreign material when the railway car mounted brake assembly 10 is in use.

The mounting bracket 80 further includes a pair of elongated members 81A and 81B. Each of the pair of elongated members 81A and 81B has a proximal end thereof disposed on and attached to the plate member 81 adjacent one side edge thereof. Each of the pair of elongated members 81A and 81B extends outwardly from the first substantially planar surface 82 of the plate member 81 to cover a portion of the peripheral exterior surface 53 of the air spring actuator 52. A portion of at least one of the pair of elongated members 81A and 81B, labeled as 81A in FIG. 3, carrying the proximal end thereof has a greater width than the remaining portion of the elongated member 81A. Such portion defines an edge 86 disposed generally perpendicular to a top edge 94 of the elongated member 81A. The edge 86 abuts the first substantially planar surface of 66 of the first plate member 61 to limit motion of the air spring actuator 50.

There is also a structure disposed on and attached to an opposed substantially planar surface 83 of the plate member 81, the structure attaching the mounting member 81 to a rigid structure.

The structure includes a flange 85 disposed, in a substantially horizontal plane during use of the air brake actuator assembly 40, on and extending outwardly from the opposed substantially planar surface 83 of the plate member 81 and a pair of apertures 98 formed through a thickness of the flange 85 in a spaced apart relationship along a length of the flange 85.

Furthermore, a support portion 100 substantially engages strut member 8 having tab member 102 and at least one mounting cavity 104 for attachment to such strut member 8 is provided to substantially minimize force loads acting on the brake actuator assembly 40 upon actuation of the hand brake mechanism (not shown). The support portion 100 extends outwardly from one side edge of the plate member 81.

The air spring 52 includes air communication means 41, best shown in FIG. 2, in fluid communication with an interior portion of at least one air spring 52 for supplying air pressure to such at least one air spring 52 to cause actuation of this air spring 52 during a brake application and also for removing or evacuating air from the air spring 52 to cause deactivation of the air spring 52 during a brake release. In the presently preferred embodiment, this air communication means 41 is at least one air inlet port. Aperture 97 is provided within the plate member 81 of the mounting bracket 80 and is substantially aligned with the air communication means 41 to enable application of the pneumatic pressure within air spring 52. Forces generated upon pressurization of the air spring 52 vary with the respect to their travel height due to the natural characteristics of the rubber. The pressurization and discharge of the air spring actuator is regulated by an external control circuit (not shown). Furthermore, these forces vary at the constant pressure applied to the air spring 52.

Any commercially available inflatable spring 52 may be used as long as this spring is capable of withstanding the amount of air pressure applied thereto and capable of providing sufficient force to move actuating member 60 to initiate a braking sequence.

First edge portion 70 and second edge portion 78 of the first plate member 61 engage first edge portion 84 and second edge portion 94 respectively of the mounting bracket 80 for guiding the air spring actuator 50 during reciprocal movement of such air spring actuator 50 to provide for linkage bail and/or misalignment without applying loads to the air spring actuator 50.

Figure 4:
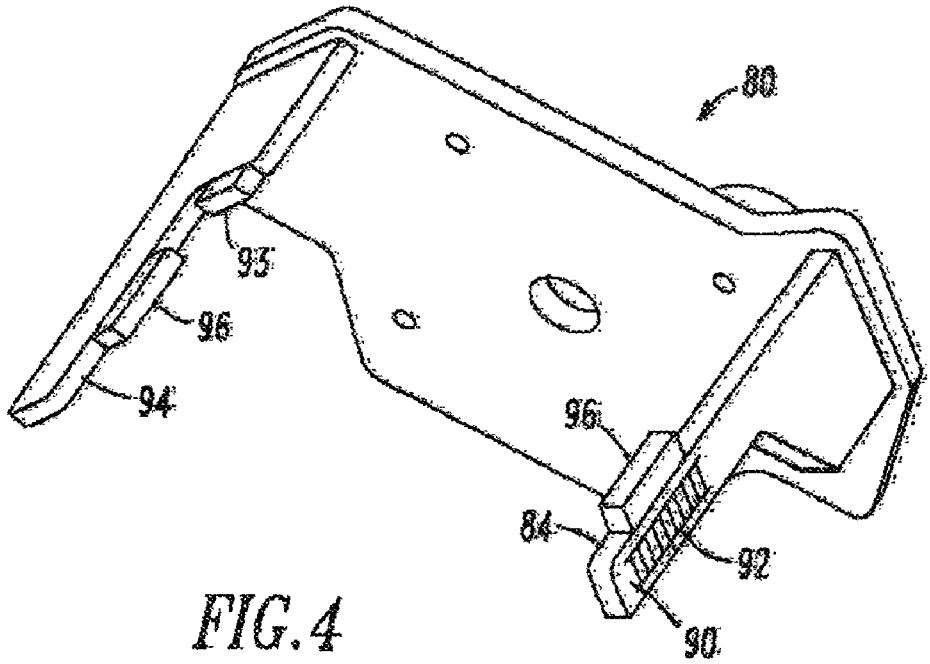
FIG. 4 is a partial perspective view of the push rod/shield actuator showing application of the wear resistant members.
Figure 5:
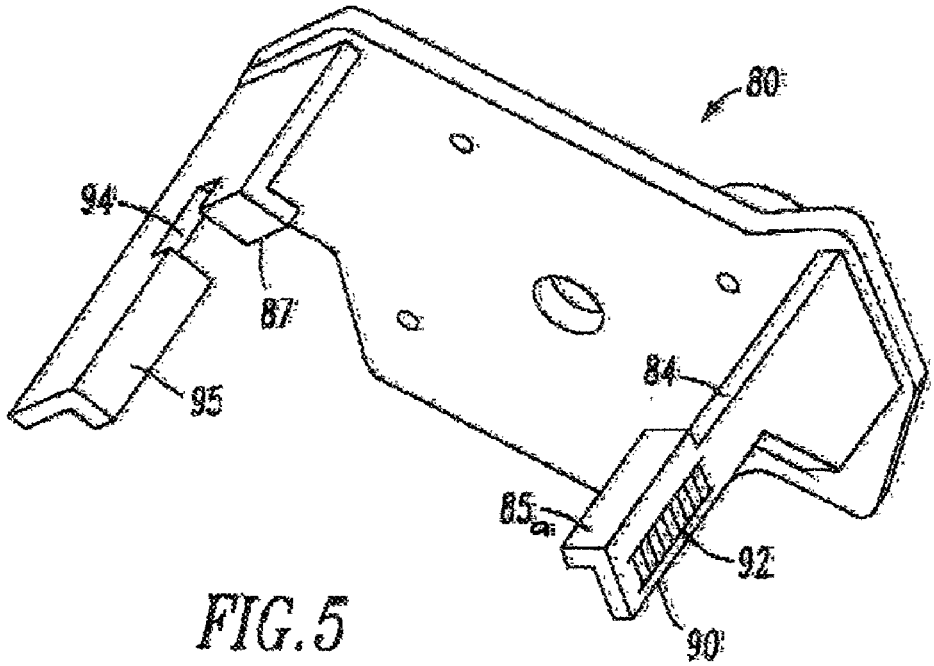
FIG. 5 is a partial perspective view of the push rod/shield actuator showing application of the wear resistant edge alternatives.

In the presently preferred embodiment, edge portions 70, 78, 84 and 94 are simple edge portions produced by either a casting or forging method. Alternatively, at least one wear resistant member 96 of predetermined material is attached to such edge portions 84 and 94, as shown in FIG. 4, to substantially minimize damage to edge surfaces 70 and 78 during railway vehicle motion. Yet alternatively, damage to edge surfaces 70 and 78 is substantially minimized by such simple edge portions 84 and 94 having second surface portions 85*a* and 95 substantially perpendicular to the edge surfaces 84 and 94 respectively as shown in FIG. 5.

In further reference to FIG. 3, a linear travel height indicator 92, representing a member for visual determination of a travel length of the air spring actuator, is attached to surface portion 90 of the mounting bracket 80 permitting determination of the forces generated upon pressurization of the air spring 52 that vary with respect to their travel height due to the natural characteristics of the rubber.

In the preferred embodiment, upon discharge of the spring actuator 50, stop portion 77 of actuating member 60 will engage a third edge portion 86 of the mounting bracket 80 preventing further motion of the spring actuator 50 and, more particularly, preventing damage to air spring 52. Alternatively, stop 77 can be incorporated and disposed internally within air spring 52 having substantially identical functionality as edge portion 86.

Furthermore, it is preferred that edge portion 86 be produced by a casting or forging process. Alternatively, at least one wear resistant member 93 of predetermined material is attached to edge portion 86 to substantially minimize damage to edge surface 77 during railway vehicle motion. Yet alternatively, damage is substantially minimized with edge portion 86 having an adjoining surface portion 87 substantially perpendicular to said edge portion 86.

Currently used brake cylinder assemblies may be retrofitted with the air spring actuator assembly of the present invention by substantially replacing the cylinder assembly with the air spring actuator assembly having a predetermined push rod/shield and mounting bracket arrangements to interface with the existing brake assembly arrangement.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A mounting member for mounting an air spring actuator to at least one brake beam of a railway car mounted brake assembly, the air spring actuator having a pair of spaced apart end surfaces and at least one inflatable air spring defining an exterior peripheral surface of the air spring actuator, each of the pair of spaced apart end surfaces having a plurality of threaded fasteners extending outwardly therefrom, said mounting member comprising:

(a) a plate member disposed substantially vertically during use of the brake assembly, said plate member having a first substantially planar surface thereof disposed in abutting relationship with one of the pair of spaced apart end surfaces of the air spring actuator, said plate member further having a plurality of mounting apertures formed through a thickness thereof, each of said plurality of mounting apertures aligned with and sized to pass therethrough a respective one of the plurality of threaded fasteners extending outwardly from the one of the pair of end surfaces, said plate member exposing the exterior peripheral surface of the at least one inflatable air spring to an atmospheric operating environment characterized by a presence of detrimental extraneous foreign material when the railway car mounted brake assembly is in use;

(b) an elongated flange disposed, in a substantially horizontal plane during use of the air spring actuator assembly, on an opposed second substantially planar surface of said plate member between top and bottom edges thereof, said elongated flange extending outwardly from said opposed second substantially planar surface of said plate member, wherein a first end of said elongated flange is positioned at about one side edge of said plate member and wherein an opposed second end of said elongated flange is positioned in proximity to an opposed side edge of said plate member;

(c) a pair of apertures formed through a thickness of said elongated flange in a spaced apart relationship along a length thereof;

(d) a support having one end thereof disposed on said second end of said elongated flange, said support extending in a direction wherein an opposed end of said support is disposed forward of said first substantially planar surface portion of said plate member, said support having a portion thereof disposed generally horizontally when said mounting member is installed on the railway car mounted brake assembly; and (e) an aperture disposed in said opposed end of said support.

2. An air brake actuator assembly, said air brake actuator assembly comprising:

(a) at least one air spring actuator having a pair of spaced apart end surfaces and an exterior peripheral surface, each of said pair of spaced apart end surfaces having a plurality of mounting members extending outwardly therefrom, wherein said exterior peripheral surface exposed to an atmospheric operating environment characterized by a presence of detrimental extraneous foreign material during use of said air spring actuator assembly;

(b) a first plate member disposed substantially vertically during use of said air brake actuator assembly, said first plate member having a first substantially planar surface thereof disposed in abutting relationship with one of said pair of spaced apart end surfaces of said at least one air spring actuator, said first plate member further having a plurality of first mounting apertures formed through a thickness thereof, each of said plurality of first mounting apertures aligned with and sized to pass therethrough a respective one of said plurality of mounting members extending outwardly from said one of said pair of spaced apart end surfaces;

(c) a second plate member disposed substantially horizontally during use of said air brake actuator assembly, said second plate member directly attached to said first plate member at a bottom edge thereof and extending substantially perpendicular to said first substantially planar surface of said first plate member for shielding at least a first portion of said exterior peripheral surface of said at least one air spring actuator from said detrimental extraneous foreign material;

(d) a first structure securing said first substantially vertically disposed plate member to an actuating linkage of a railway vehicle brake assembly;

(e) a third plate member disposed substantially vertically during use of said air brake actuator assembly, said third plate member having a first planar surface thereof disposed in abutting relationship with an opposed one of said pair of spaced apart end surfaces of said at least one air spring actuator, said third plate member further having a plurality of second mounting apertures formed through a thickness thereof, each of said plurality of second mounting apertures aligned with and sized to pass therethrough a respective one of said plurality of mounting members extending outwardly from said opposed one of said pair of end surfaces;

(f) a second structure disposed on an opposed substantially planar surface of said third plate member and attaching said air spring actuator assembly to a rigid structure;

(g) a pair of plate portions disposed planar with said first plate member adjacent a top edge thereof, each of said pair of plate portions protruding outwardly from a respective side edge of said first plate member;

(h) a pair of elongated members, each of said pair of elongated members having a proximal end thereof disposed on and attached to said third plate member adjacent one side edge thereof, said each of said pair of elongated members extending outwardly from said first substantially planar surface of said third plate member in a direction toward said first plate member; and (i) abutment between a top edge of each of said pair of elongated members with an edge of a respective one of said pair of plate portions during motion of said at least one air spring actuator.

3. An air brake actuator assembly, according to claim 2, wherein said first structure includes a pair of second elongated members disposed substantially horizontally and spaced apart in a vertical plane during use of said air brake assembly, each of said pair of spaced apart second elongated members having a proximal end thereof disposed on and attached to an opposed substantially planar surface of said first plate member, a distal end thereof extending outwardly and substantially perpendicular to said first plate member, and an aperture formed through a thickness of said each of said pair of second elongated members adjacent to and spaced from said distal end thereof.

4. An air brake actuator assembly, according to claim 2, wherein said air spring actuator further includes an air inlet in communication with said at least one air spring actuator.

5. An air brake actuator assembly, according to claim 2, wherein said air spring actuator further includes a member for visual determination of a travel length of said air spring actuator.

6. An air brake actuator assembly, according to claim 5, wherein the visual travel determination member is a linear measuring device.

7. An air brake actuator assembly, according to claim 2, wherein said air brake actuator assembly further includes an air communication device.

8. In combination with a railway car brake assembly, an air brake actuator assembly comprising:

(a) at least one air spring actuator having a pair of spaced apart end surfaces and an exterior peripheral surface, each of said pair of spaced apart end surfaces having a plurality of mounting members extending outwardly therefrom, wherein said exterior peripheral surface exposed to an atmospheric operating environment characterized by a presence of detrimental extraneous foreign material during use of said air spring actuator assembly;

(b) a first plate member disposed substantially vertically during use of said air brake actuator assembly, said first plate member having a first substantially planar surface thereof disposed in abutting relationship with one of said pair of spaced apart end surfaces of said at least one air spring actuator, said first plate member further having a plurality of first mounting apertures formed through a thickness thereof, each of said plurality of first mounting apertures aligned with and sized to pass therethrough a respective one of said plurality of mounting members extending outwardly from said one of said pair of spaced apart end surfaces;

(c) a second plate member disposed substantially horizontally during use of said air brake actuator assembly, said second plate member directly attached to said first plate member at a bottom edge thereof and extending substantially perpendicular to said first substantially planar surface of said first plate member for shielding a bottom portion of said exterior peripheral surface of said at least one air spring actuator from said detrimental extraneous foreign material;

(d) a pair of elongated connecting members disposed substantially horizontally and spaced apart in a vertical plane during use of said air brake actuator assembly, each of said pair of spaced apart elongated connecting members having a proximal end thereof disposed on and attached to an opposed substantially planar surface of said first plate member, a distal end thereof extending outwardly and substantially perpendicular to said first plate member, and a pair of apertures, each of said pair of apertures formed in operative alignment through a thickness of a respective one of said pair of elongated connecting members adjacent to and spaced from said distal end thereof;

(e) a third plate member disposed substantially vertically during use of said air brake actuator assembly, said third plate member having a first planar surface portion thereof disposed in abutting relationship with an opposed one of said pair of spaced apart end surfaces of said at least one air spring actuator, said third plate member further having a plurality of second mounting apertures formed through a thickness thereof, each of said plurality of second mounting apertures aligned with and sized to pass therethrough a respective one of said plurality of mounting members extending outwardly from said opposed one of said pair of end surfaces;

(f) a flange disposed, in a substantially horizontal plane during use of said air brake actuator assembly, on and extending outwardly from said opposed substantially planar surface of said third plate member;

(g) a pair of apertures formed through a thickness of said flange in a spaced apart relationship along a length thereof;

(h) a support extending outwardly from one side edge of said third plate member and having a portion thereof disposed generally horizontally during use of said at least one air spring actuator assembly;

(i) a tab extending downwardly from a bottom surface of said portion of said support;

(j) an aperture formed through a thickness of said tab;

(k) an aperture formed through a thickness of said third plate member in operative alignment with an inlet port of said at least one air spring actuator;

(l) a pair of plate portions disposed planar with said first plate member adjacent a top edge thereof, each of said pair of plate portions protruding outwardly from a respective side edge of said first plate member;

(m) a pair of elongated members, each of said pair of elongated members having a proximal end thereof disposed on and attached to said third plate member adjacent one side edge thereof, said each of said pair of elongated members extending outwardly from said first substantially planar surface of said third plate member in a direction toward said first plate member to cover a portion of the peripheral surface of said at least one air spring actuator;

(n) engagement between a top edge of each of said pair of elongated members with an edge of a respective one of said pair of plate portions during use of said at least one air brake actuator assembly;

(o) a plate portion extending from a top edge of one of said one of said pair of elongated members and defining an edge disposed generally perpendicular to said top edge of said one of said pair of elongated members; and (p) abutment of said edge of said plate portion extending from said top edge of said one of said pair of elongated members with said first substantially planar surface of said first plate member to limit motion of said at least one air spring actuator.

9. The air brake actuator assembly, according to claim 8, wherein said top edge of said each of said pair of elongated members includes a wear resistant member, wherein a surface of said wear resistant member engages said edge of said respective one of said pair of plate portions during use of said air brake actuator assembly.

10. The air brake actuator assembly, according to claim 8, wherein each of said pair of elongated members includes a flange extending inwardly from said top edge thereof, wherein a top surface of said flange of said each of said pair of elongated members engages said edge of said respective one of said pair of plate portions during use of said air brake actuator assembly.

11. An air brake actuator assembly, said air brake actuator assembly comprising:

(a) at least one air spring actuator having a pair of spaced apart end surfaces and an exterior peripheral surface, each of said pair of spaced apart end surfaces having a plurality of mounting members extending outwardly therefrom, wherein said exterior peripheral surface exposed to an atmospheric operating environment characterized by a presence of detrimental extraneous foreign material during use of said air spring actuator assembly;

(b) a first plate member disposed substantially vertically during use of said air brake actuator assembly, said first plate member having a first substantially planar surface thereof disposed in abutting relationship with one of said pair of spaced apart end surfaces of said at least one air spring actuator, said first plate member further having a plurality of first mounting apertures formed through a thickness thereof, each of said plurality of first mounting apertures aligned with and sized to pass therethrough a respective one of said plurality of mounting members extending outwardly from said one of said pair of spaced apart end surfaces;

(c) a second plate member disposed substantially horizontally during use of said air brake actuator assembly, said second plate member directly fixedly attached to said first plate member at a bottom edge thereof and extending substantially perpendicular to said first substantially planar surface of said first plate member for shielding at least a first portion of said exterior peripheral surface of said at least one air spring actuator from said detrimental extraneous foreign material;

(d) a first structure securing said first substantially vertically disposed plate member to an actuating linkage of a railway vehicle brake assembly;

(e) a third plate member disposed substantially vertically during use of said air brake actuator assembly, said third plate member having a first planar surface portion thereof disposed in abutting relationship with an opposed one of said pair of spaced apart end surfaces of said at least one air spring actuator, said third plate member further having a plurality of second mounting apertures formed through a thickness thereof, each of said plurality of second mounting apertures aligned with and sized to pass therethrough a respective one of said plurality of mounting members extending outwardly from said opposed one of said pair of end surfaces;

(f) a second structure disposed on an opposed substantially planar surface of said third plate member and attaching said air spring actuator assembly to a rigid structure;

(g) at least one plate portion disposed planar with said first plate member and protruding outwardly therefrom; and (h) at least one elongated member having a proximal end thereof disposed on and fixedly attached to said first substantially planar surface of said third plate member, said at least one elongated member extending outwardly from said first substantially planar surface of said third plate member in a direction toward said first plate member, so that said at least one plate portion reciprocally travels along a length of said at least one elongated member.

12. An air brake actuator assembly, said air brake actuator assembly comprising:

(a) at least one air spring actuator having a pair of spaced apart end surfaces and an exterior peripheral surface, each of said pair of spaced apart end surfaces having a plurality of mounting members extending outwardly therefrom, wherein said exterior peripheral surface exposed to an atmospheric operating environment characterized by a presence of detrimental extraneous foreign material during use of said air spring actuator assembly;

(b) a first plate member disposed substantially vertically during use of said air brake actuator assembly, said first plate member having a first substantially planar surface thereof disposed in abutting relationship with one of said pair of spaced apart end surfaces of said at least one air spring actuator, said first plate member further having a plurality of first mounting apertures formed through a thickness thereof, each of said plurality of first mounting apertures aligned with and sized to pass therethrough a respective one of said plurality of mounting members extending outwardly from said one of said pair of spaced apart end surfaces;

(c) a second plate member disposed substantially horizontally during use of said air brake actuator assembly, said second plate member directly attached to said first plate member at a bottom edge thereof and extending substantially perpendicular to said first substantially planar surface of said first plate member for shielding at least a first portion of said exterior peripheral surface of said at least one air spring actuator from said detrimental extraneous foreign material;

(d) a first structure securing said first substantially vertically disposed plate member to an actuating linkage of a railway vehicle brake assembly;

(e) a third plate member disposed substantially vertically during use of said air brake actuator assembly, said third plate member having a first substantially planar surface thereof disposed in abutting relationship with an opposed one of said pair of spaced apart end surfaces of said at least one air spring actuator, said third plate member further having a plurality of second mounting apertures formed through a thickness thereof, each of said plurality of second mounting apertures aligned with and sized to pass therethrough a respective one of said plurality of mounting members extending outwardly from said opposed one of said pair of end surfaces; and (f) an elongated flange disposed, in a substantially horizontal plane during use of said air spring actuator assembly, on an opposed second substantially planar surface of said third plate member between top and bottom edges thereof, said elongated flange extending outwardly from said opposed second substantially planar surface of said third plate member, wherein a first end of said elongated flange is positioned at about one side edge of said third plate member and wherein an opposed second end of said elongated flange is positioned in close proximity to an opposed side edge of said third plate member;

(g) a pair of apertures formed through a thickness of said elongated flange in a spaced apart relationship along a length thereof; and (h) a support having one end thereof disposed on said second end of said elongated flange, said support extending in a direction towards said first plate member, wherein an opposed end of said support is disposed forward of said first substantially planar surface of said third plate member, said support having a portion thereof disposed generally horizontally when said mounting member is installed on the railway car mounted brake assembly.

* * * * *